US007235729B2

(12) United States Patent
Minakuchi

(10) Patent No.: US 7,235,729 B2
(45) Date of Patent: Jun. 26, 2007

(54) STRING SECURING APPARATUS FOR STRING INSTRUMENT

(75) Inventor: Kiyoshi Minakuchi, Hamamatsu (JP)

(73) Assignee: Yamaha Corporation, Shizuoka-Ken (JP)

( * ) Notice: Subject to any disclaimer, the term of this patent is extended or adjusted under 35 U.S.C. 154(b) by 192 days.

(21) Appl. No.: 11/078,512

(22) Filed: Mar. 14, 2005

(65) Prior Publication Data

US 2005/0204892 A1 Sep. 22, 2005

(30) Foreign Application Priority Data

Mar. 19, 2004 (JP) ..... 2004-080272

(51) Int. Cl.
*G10D 3/12* (2006.01)
*G10D 3/04* (2006.01)

(52) U.S. Cl. ..... 84/298; 84/298; 84/297 R; 84/213; 84/214; 84/299; 84/307; 84/314 N

(58) Field of Classification Search ..... 84/213, 84/214, 297 R, 298, 299, 307, 313, 314 N
See application file for complete search history.

(56) References Cited

U.S. PATENT DOCUMENTS 4,475,432 A * 10/1984 Stroh ..... 84/314 N
4,497,236 A * 2/1985 Rose ..... 84/298
D280,330 S * 8/1985 Tanaka et al. ..... D17/20
4,549,461 A * 10/1985 Rose ..... 84/313
4,574,678 A * 3/1986 Edwards ..... 84/314 N
4,579,033 A * 4/1986 Edwards ..... 84/314 N
4,589,321 A * 5/1986 Pritchard ..... 84/297 R
D290,017 S * 5/1987 Edwards ..... D17/20
4,667,561 A * 5/1987 Storey et al. ..... 84/314 N
4,674,387 A * 6/1987 Caruth ..... 84/304
4,690,028 A * 9/1987 Steinberger ..... 84/314 N
RE32,863 E * 2/1989 Edwards ..... 84/314 N
4,872,388 A * 10/1989 Gunn ..... 84/297 R
4,878,413 A * 11/1989 Steinberger ..... 84/314 N
4,944,208 A * 7/1990 Kusek ..... 84/313
5,109,745 A * 5/1992 Tomita ..... 84/313
5,127,299 A * 7/1992 Stroh et al. ..... 84/314 N
5,277,094 A * 1/1994 Spuler ..... 84/298

(Continued)

FOREIGN PATENT DOCUMENTS

JP 63-033242 9/1988

(Continued)

*Primary Examiner*—Lincoln Donovan
*Assistant Examiner*—Robert W. Horn
(74) *Attorney, Agent, or Firm*—Dickstein Shapiro LLP

(57) ABSTRACT

The string securing apparatus for string instrument of this invention arranges a plurality of saddle-attaching members on the top face of a bridge base in correspondence with strings, and secures them to the bridge base so that they can be movably adjusted in the front-rear direction. A bridge saddle is attached to each saddle-attaching member so as to rotate up and down. The string is inserted through a pipe section in the bridge saddles and led above the bridge saddles by a lever attachment hole; the string is curved forward to a string supporting section. A cam lever is inserted in the lever attachment hole of the bridge saddles so as to freely rotate, and a spring presses the cam lever forward. A cam section of the cam lever pushes the string and secures it by tightening it to the string supporting section.

4 Claims, 5 Drawing Sheets

U.S. PATENT DOCUMENTS

| | | | | |
|---|---|---|---|---|
| 5,456,151 | A * | 10/1995 | Enserink | 84/297 R |
| 5,932,822 | A * | 8/1999 | Bernstein | 84/314 N |
| 6,528,710 | B2 * | 3/2003 | Steinberger | 84/312 R |
| 6,806,411 | B1 * | 10/2004 | Allen | 84/454 |
| 6,867,354 | B2 * | 3/2005 | Shimooka et al. | 84/312 R |
| 6,989,483 | B2 * | 1/2006 | Ramsay | 84/313 |
| 6,998,525 | B2 * | 2/2006 | Erismann | 84/297 R |
| 2004/0255752 | A1 * | 12/2004 | Geier | 84/313 |
| 2005/0150347 | A1 * | 7/2005 | Hannes | 84/297 R |
| 2005/0204892 | A1 * | 9/2005 | Minakuchi | 84/298 |
| 2006/0236841 | A1 * | 10/2006 | LeBlanc | 84/298 |

FOREIGN PATENT DOCUMENTS

| | | |
|---|---|---|
| JP | 63-044864 | 11/1988 |
| JP | 02-119300 | 9/1990 |
| JP | 07-056558 | 3/1995 |
| JP | 2003-114683 | 4/2003 |

* cited by examiner

STRING SECURING APPARATUS FOR STRING INSTRUMENT

BACKGROUND OF THE INVENTION

1. Field of the Invention

The present invention relates to a string securing apparatus for string instrument and, more particularly, to a string securing apparatus for string instrument that is used as a tremolo apparatus for an electric guitar.

Priority is claimed on Japanese Patent Application No. 2004-80272, filed Mar. 19, 2004, the content of which is incorporated herein by reference.

2. Description of Related Art

An electric guitar can obtain a special sound effect known as a tremolo effect, in which the musical interval is minutely increased and decreased by using a tremolo apparatus to repeatedly change the tension of a string in rapid cycles (e.g. see Japanese Unexamined Utility Model Application, First Publication No. Hei 2-119300, and Japanese Examined Utility Model Publication Nos. Sho 63-44864 and Sho 63-33242).

The tremolo apparatus includes a bridge base that is attached to the body of the guitar in a manner that it can pivot on the body of the guitar, and a plurality of bridge saddles that are arranged on the bridge base in correspondence with respective strings. One end of each string is secured to its respective bridge saddle, and the other end is wound around a peg (turning screw) provided at a head (the end of the neck) of the guitar. The most common method of securing the strings to the bridge saddles is a tightening method in which a clamp member is attached to the bridge saddle by using bolts, and securely tightens the strings to the bridge saddles. In other words, the strings are fastened in place by the bridge saddles and the clamp members (e.g. see Japanese Unexamined Patent Applications, First Publication Nos. 7-56558 and 2003-114683).

A tremolo apparatus for guitar disclosed in Japanese Unexamined Patent Application, First Publication No. 7-56558 uses a tightening manner that is similar to the conventional one described above. Saddle members are provided on a bridge plate (bridge base), blocks for clamps are fitted to the saddle members, the ends of the strings are inserted between the block for clamps and the saddle members, and bolts are used to securely tighten the block for clamps to the saddle members, thereby clamping the strings to the saddle members.

In a tremolo apparatus disclosed in the aforementioned Japanese Unexamined Patent Application, First Publication No. 2003-114683, saddle-attaching members are provided on the base plate so that they can be movably adjusted in the head-side and the tail-side directions, saddles are fitted on the saddle-attaching members so that the saddles can rotate freely upward and downward, and clamp pads are provided over the saddles. Ends of the strings are inserted between the clamp pads and the saddles, and bolts are used to tightly secure the clamp pads to the saddles, thereby securing the strings to the saddles.

Such kind of the conventional tremolo apparatus that uses the tightening method will be described in detail with reference to FIGS. 7 to 9. FIG. 7 is a plan view of the tremolo apparatus used in a guitar, FIG. 8 is a cross-sectional view taken along the line VIII-VIII of FIG. 7 in which a front face of the guitar is shown in the upper side and a rear face thereof is shown in lower side, and FIG. 9 is a perspective view of the tremolo apparatus.

In FIGS. 7 to 9, a body 1 of an electric guitar is formed with a storage recess 2 which is adapted to receive some of the constituent parts of a tremolo apparatus 3. A plurality of (six) strings are clamped along the body 1.

The tremolo apparatus 3 includes a bridge base 5, six bridge saddles 6, each of which is provided on the bridge base 5 to hold one end of each of the strings 4. Each of clamp members 7 tightly secures the one end of each of the strings 4 to the bridge saddles 6. The bridge base 5 has a tremolo arm 8 that protrudes from the treble string side (upper side in FIG. 7, it may be referred to as "treble side" hereinafter) of its front face, and is arranged on the body 1 so as to cover the storage recess 2. A pair of fulcrum sections 9 are shaped like a knife-edge, and are formed at the treble side end and bass string side (lower side in FIG. 7, it may be referred to as "bass side" hereinafter) end of a head side (leftward side in FIG. 7) of the bridge base 5. A pair of fulcrum pins 11 protrude from the front side of the body 1 to be located to correspond to the respective fulcrum sections 9. The fulcrum sections 9 are pressingly connected the fulcrum pins 11, respectively, by the spring force S of a balance spring 12 and the tension T of the strings 4 toward the head side. The balance spring 12 is located in the storage recess 2, with its head-side end interlocking with a metal fitting 13 provided in the inner wall of the storage recess 2, and its tail-side (rightward side in FIGS. 7 and 8) end connecting to the bottom end of the bridge base 5. Consequently, the bridge base 5 receives a counterclockwise (as viewed in FIG. 8) rotational momentum M1 of the tension T of the strings 4 with the fulcrum section 9 as a rotational fulcrum or a pivot, and a clockwise rotational momentum M2 (M1=M2) of the spring force S of the balance spring 12, holding the bridge base 5 in a flat state that is usually approximately horizontal.

Six saddle-attaching members 14 are secured by bolts 15 at the head-side end of the front face of the bridge base 5 in correspondence with the respective strings 4. Each of the saddle-attaching members 14 is provided with a string-length adjusting screws 24 for sliding movement toward the head-side and the tail-side directions (the stretch direction of the strings 4), as explained later. The bridge saddles 6 are connected to the saddle-attaching members 14 at the head side of the bridge saddles 6 via a rotational axis 16 so as to be able to rotate freely to the front and rear directions.

Openings 17 for storing the clamp members 7 are provided in the center of the front faces of the bridge saddles 6. Pipe sections 18 for inserting the strings 4 extend down from the center of the rear faces of the bridge saddles 6. The insides of the pipe sections 18 connect to the openings 17, and the pipe sections 18 lock with ball ends 19 that are affixed to the ends of the strings 4 by their rear or bottom faces.

The clamp members 7 are incorporated into the openings 17 in the bridge saddles 6 so that they can slide forward and backward (in the head-side and tail-side directions). A lock bolt 20 moves each the clamp member 7 forward, securely tightening the string 4 to the head-side wall of the opening 17. The lock bolts 20 are hexagonal hole-fitted bolts, being the same shape as the bolts 15, and each is fastened or loosed by an L-shaped wrench 21.

String-adjusting screws 23 that minutely adjust the tension of the respective strings 4 are fitted to the front face of the tail-side end of the bridge base 5, and the bottom or rear ends of the string-adjusting screws 23 directly contact the front faces of the lock bolts 20. When the string-adjusting screws 23 are tightened so as to press the lock bolts 20 downward, the bridge saddles 6 rotate around the rotational axis 16 in the clockwise direction (as viewed in FIG. 8). This increases the tension of the strings 4 by pulling them to the tail side. Conversely, when the string-adjusting screws 23 are loosened, the tension of the strings 4 causes the bridge saddles 6 to rotate in the counterclockwise direction, lowering the tension of the strings 4.

The string-length adjusting screws 24 are fitted to the rear face of the tail-side end of the bridge base 5, and movably adjust the saddle-attaching members 14 by moving them in the head-side and tail-side directions. Since the string-length adjusting screws 24 are provided in order to adjust the actual string length (slightly longer than the logical string length) of the strings 4 having different thicknesses. The adjusting screws 24 are rotatably attached to the tail side of the bridge base 5 and their head sides are screwed into screw holes provided in the tail side ends of the saddle-attaching members 14. Therefore, when one string-length adjusting screw 24 is rotated so as to adjust the saddle-attaching member 14 by moving it to the head-side direction, the bridge saddle 6 also moves to the same direction together with the saddle-attaching member 14, adjusting the actual string length of the string 4. Incidentally, when using the string-length adjusting screw 24 to adjust the position of the bridge saddle 6, the bolt 15 is loosened beforehand to enable the saddle-attaching member 14 to slide freely with respect to the bridge base 5.

The tremolo apparatus 3 having the above constitution obtains a special sound effect known as the tremolo effect by plucking the string 4 with a plectrum or a finger, and then using a tremolo arm 8 to repeatedly cause the pivotal movement of the bridge base 5 in rapid cycles with the fulcrum pin 11 as its pivot. This operation repeatedly changes the length of the string 4, in other words, changes the tension of the strings 4, whereby the musical interval is minutely increased and decreased.

However, since the conventional tremolo apparatuses described above secures the strings to the bridge saddles by using bolts to tighten the clamp members, the bolt must be loosened and then retightened by using a suitable tool, such as an L-shaped wrench every time a string is replaced.

In particular, since the tremolo apparatuses disclosed in the aforementioned Japanese Unexamined Patent Application, First Publications Nos. 7-56558 and 2003-114683 use the clamp member for tightening near the ends of the strings, it is necessary to cut off the ends of the strings beforehand by using pinchers or the like to remove their ring-shaped ball ends in order to prevent the ball ends from becoming obstructive.

Further, the conventional tremolo apparatus 3 shown in FIGS. 7 to 9 has a disadvantage of poor outside appearance, since the bolts 15 for securing the saddle-attaching members 14 to the bridge base 5 are exposed on the front face of the saddle-attaching members 14.

SUMMARY OF THE INVENTION

The present invention has been realized in order to solve the shortcomings described above, and aims to provide a string securing apparatus for string instrument that utilizes a tightening manner using a lever like members instead of bolts and clamp members, and enables strings to be reliably secured by a manual level operation without requiring a tool such as a wrench.

In order to achieve the above objects, the string securing apparatus for stringed instrument of the present invention comprises a bridge base-fitted to a guitar body, a plurality of saddle-attaching members secured on the bridge base, and a plurality of bridge saddles that are attached to the saddle-attaching members and secure one end of respective strings. A string supporting section is fitted to the bridge saddles, and supports the vicinity of the ends of the strings. A cam lever or pressing member is fitted to the string supporting section so as to touch it and be separated from it. When the cam lever or pressing member touches the string support section, it presses the vicinity of the end of the string and secures the string to the string supporting section.

The cam lever may be fitted to the bridge saddles so as to make pivotal movement and move forwards and backwards along a longitudinal direction of strings, and is pressed forward by pressing means.

A lever attachment hole for arranging the cam lever may be provided in the bridge saddle, securing member that secure the saddle-attaching members to the bridge base being arranged inside or below the level attachment hole of the bridge saddle.

DESCRIPTION OF THE PREFERRED EMBODIMENT

Figure 1:
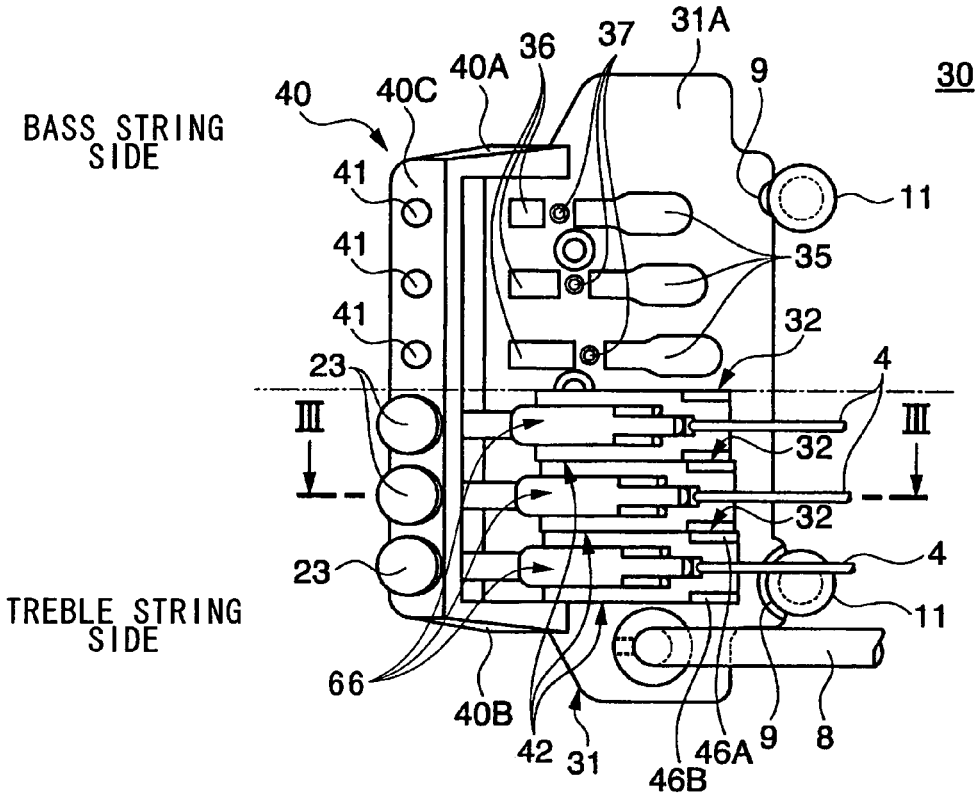
FIG. 1 is a plan view showing a string securing apparatus applied in a tremolo apparatus for an electric guitar according to an embodiment of the present invention.

An embodiment of the present invention will now be explained in detail referring to the drawings. In the drawings, constituent members that are the same as those in the conventional apparatus are represented by the same reference numerals, and the explanation thereof may be omitted.

Figure 2:
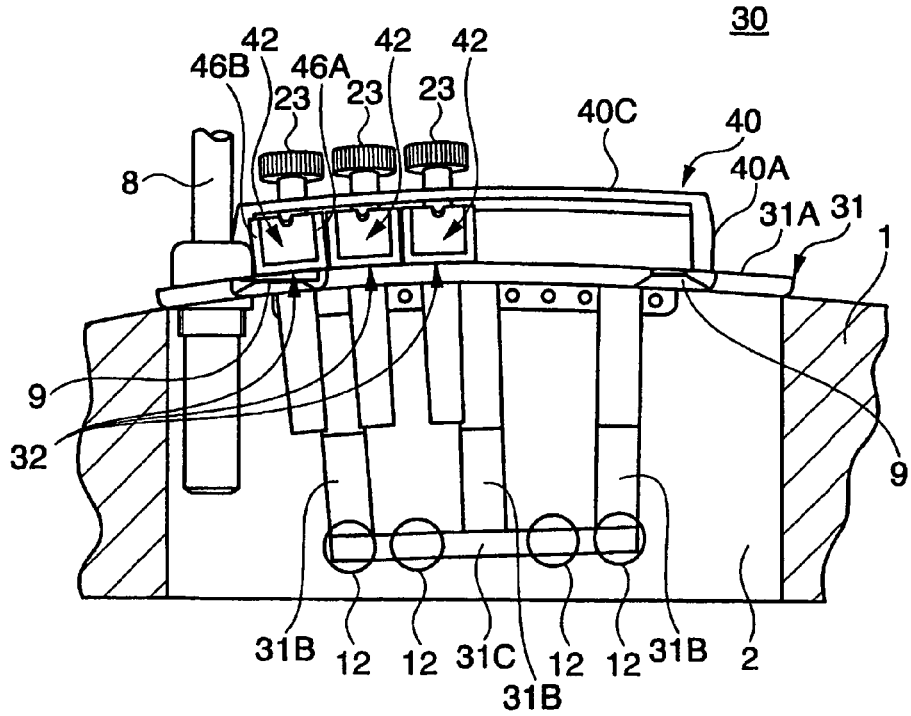
FIG. 2 is a front view showing the tremolo apparatus shown in FIG. 1.

Referring to FIGS. 1 and 2, a tremolo apparatus 30 includes a bridge base 31 which is arranged on a body 1 of an electric guitar to be able to pivotally move upwards and downwards with a pair of fulcrum pins 11 as its fulcrums. The fulcrum pins 11 are located on a bass string side and treble string side of the body 1 to be contacted to knife-edged fulcrum sections 9 formed on a head-side (rightward side in FIG. 1) edge of the bridge base 31.

The bridge base 31 includes a plate-like base body 31A, three legs 31B extending in a rear direction (downward direction in FIG. 2) and arranged substantially parallel to each other with a substantially equal intervals at the center of the rear face of the base body 31A in the width direction perpendicular to the longitudinal direction of the strings 4. Each of the rear ends of the legs 31B are connected together by a connector 31C which is attached with balance springs 12 (see FIG. 3). As best shown in FIG. 2, the base body 31A is curved to form a convex face approximately the same as the surface of the guitar body 1. A tremolo arm 8 stands at the treble string side on the front face of the base body 31A with its free end curved in the head-side direction. Six saddle-attaching members 32 are arranged along the width direction of the base body 31A in correspondence with the strings 4, and are secured by respective bolts 15 so as to be movably adjustable in the head-side direction and a tail-side direction (leftward direction in FIG. 1). The bolts 15 are formed with a hexagonal screw hole at its head for screwing the same.

Six sets of two types of elongated holes 35 and 36 and six screw holes 37 are formed at intervals in the front face of the base body 31A along the width direction so as to be positioned below the respective saddle-attaching members 32. The elongated holes 35 and 36 are formed at regular intervals in the longitudinal direction of the strings 4. The screw holes 37 are formed at a position between the respective elongated holes 35 and 36. The elongated holes 35 formed on the head side have all the same length. However, the positions of the elongated holes 35 on the bass string side gradually deviate to the tail side so that the elongated hole 35 located on the most bass string side is positioned on the most tail side while that located on the most treble side is positioned on the most head side. Similarly, the elongated hole 35 located on more bass string side is positioned on more tail side. This structure enables to make the valid string length of bass strings longer than that of treble strings. The elongated hole 36 at the tail side is shortest at the most bass string side, gradually longer with positions along with the treble string side direction, and longest at the most treble string side. The bolts 15 are screwed from the front face into the screw holes 37 between the long holes 35 and 36 to attach the saddle-attaching members 32 on the base body 31A.

A screw-attaching section 40 for adjusting screws 23 is formed to protrude from the tail-side end of the base body 31A. The screw-attaching section 40 includes a pair of bass side and treble side legs 40A and 40B, that protrude together upwardly and diagonally to the bass and treble side edges on the tail-side end of the base body 31A. The screw-attaching section 40 also includes a connecting plate 40C that connects the legs 40A and 40B. The connecting plate 40C inclines at a predetermined angle with respect to the plane of the base body 31A so that its tail-side end is lower than its head side end. Six screw holes 41 are formed through the connecting plate 40C into which the respective adjusting screws 23 are screwed. The tips of the adjusting screws 23 protrude below the connecting plate 40C.

Figure 3:
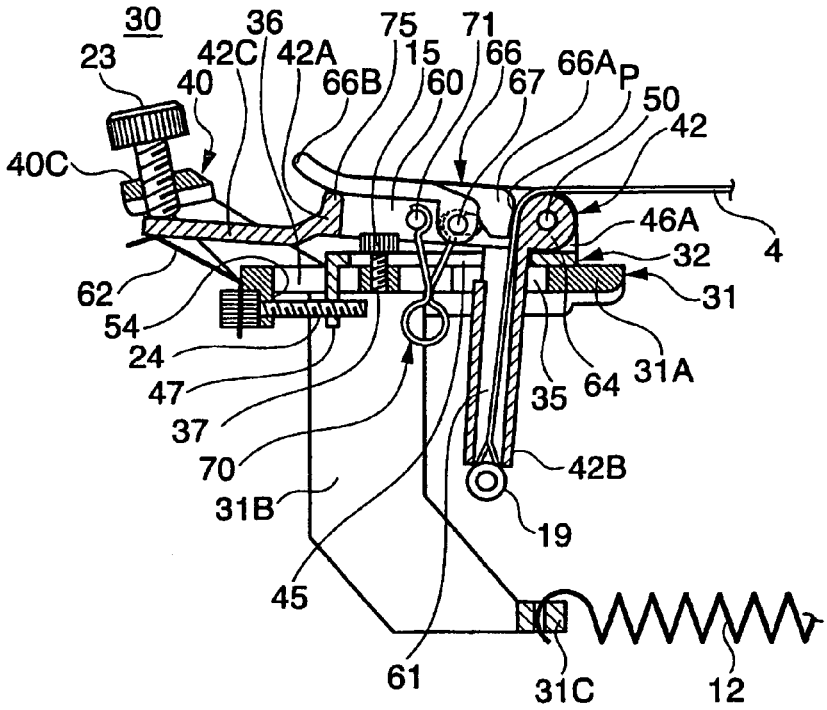
FIG. 3 is a cross-sectional view taken along the line III-III of FIG. 1.
Figure 8:
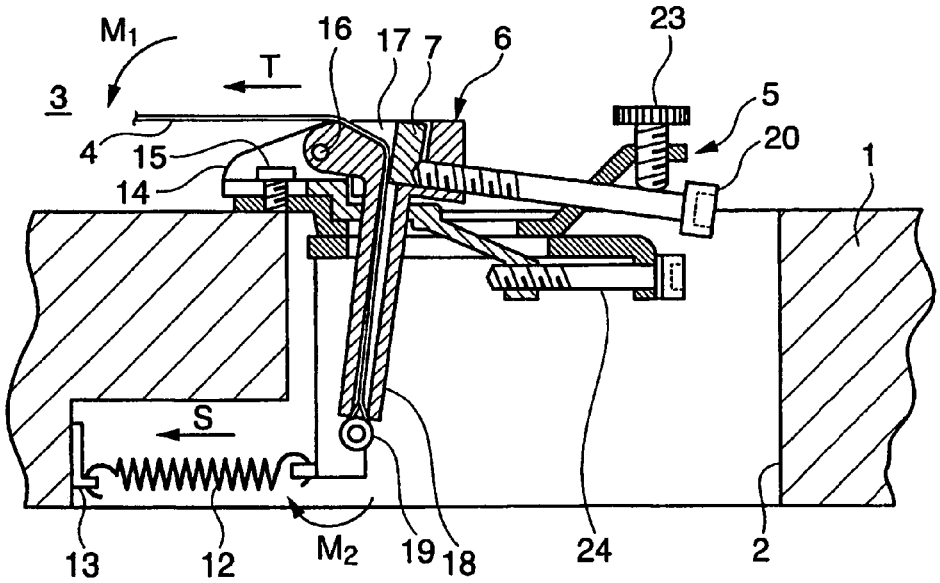
FIG. 8 is a cross-sectional-view-taken along the line VIII-VIII of FIG.7.
Figure 9:
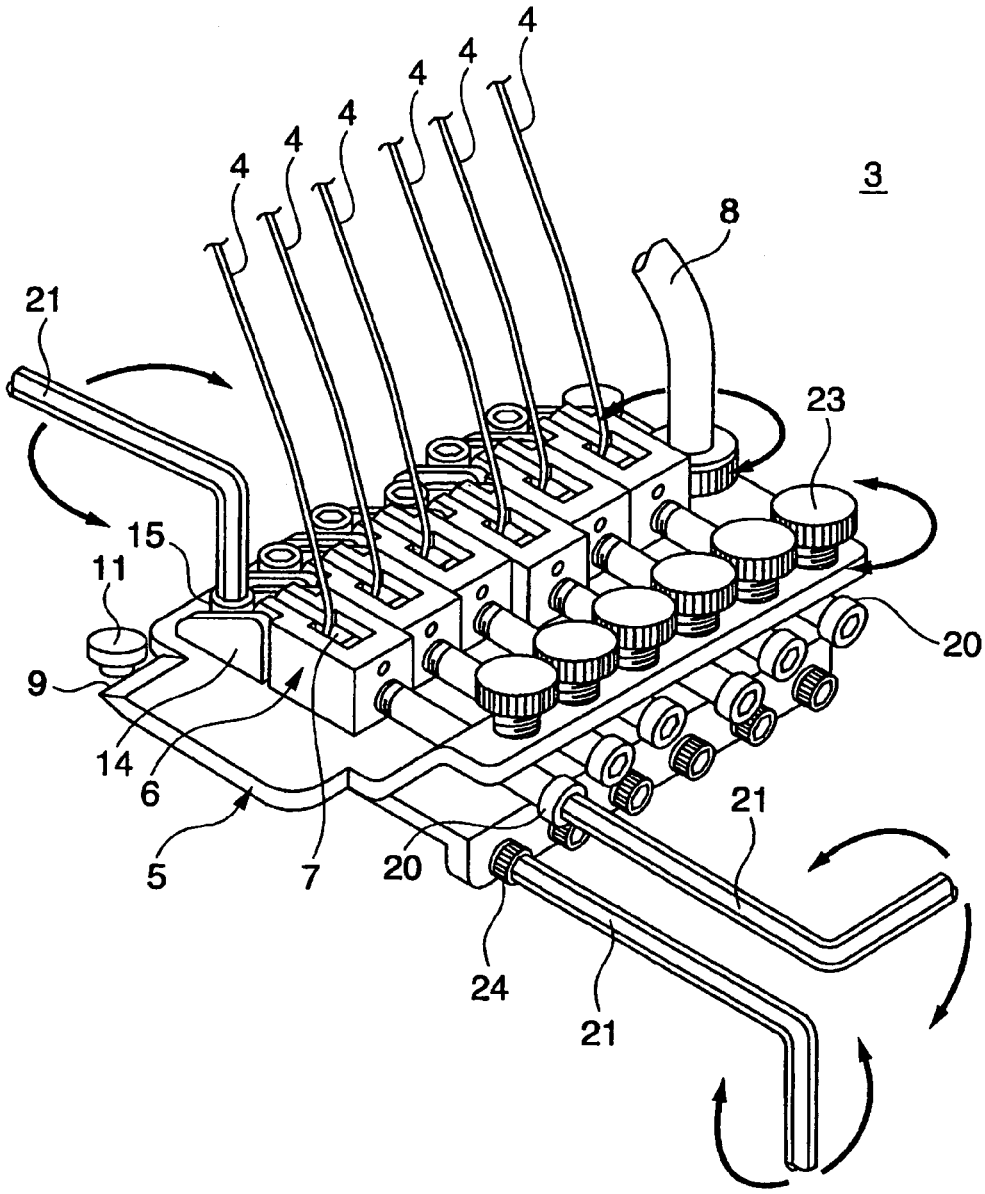
FIG. 9 is a perspective view showing the conventional tremolo apparatus shown in FIG. 7.

As shown in FIG. 3, the tail side ends of the balance springs 12 are connected in parallel to the connector 31C of the bridge base 31. The head side ends of the balance springs 12 are respectively connected to a metal fitting 13 (similar to the element shown in FIG. 8) provided on the inner wall of a storage recess 2 at the head side in the body 1 to make pressing contact with the knife-edge-shaped fulcrum sections 9 formed on the bridge base 31 against the fulcrum pins 11 together with the strings 4. The total spring force of the balance springs 12 balances the total tension of the strings 4 so that the tremolo apparatus, i.e., the bridge base 31, is usually held in an approximately horizontal state as is shown in FIG. 3. In this embodiment, four balance springs 12 are attached on the connector 31C and used for balancing the total tension of the strings 4.

The saddle-attaching members 32 have the shapes of long plates extending in the longitudinal direction of the strings 4, and in their centers have elongated holes 45 extending in the longitudinal direction. A pair of opposing side walls 46A and 46B protrude together at the both sides of the head-side ends of each of the saddle-attaching members 32, and a connector 47 extend in the rear-face direction (downward in FIG. 3) from the tail-side end of each of the saddle-attaching members 32. A rotational axis 50 runs between the pair of side walls 46A and 46B at the head-side end of the saddle-attaching member 32, and allows the tail-side ends of a bridge saddle 42 to pivotally rotate upwards and downwards in FIG. 3. The connector 47 is inserted from the front-face side into the long hole 36 in the bridge base 31 and protrude to the rear-face side from the bridge base 31. The connector 47 is connected by a string-length adjusting screw 24 to a connector 54 that formed by bending the tail-side end of the base body 31A. The string-length adjusting screw 24 is inserted from the tail side into a through-hole provided in the connector 54 of the base body 31A so as to freely rotate therein, and at its head-side end is screwed into a screw hole provided in the connector 47 of the saddle-attaching member 32. Therefore, each of the saddle-attaching members 32 can be shifted and movably adjusted to the head-side or the tail-side direction relative to the base body 31A by loosening the respective bolts 15 and rotating the respective string-length adjusting screws 24. As already mentioned, the positions of the saddle-attaching members 32 are arranged further to the tail side nearer the bass string side, and further to the head side nearer the treble string side, due to the deviated positions of the respective elongated holes 35 in the bridge base 31 as shown in FIG. 1.

Each of the bridge saddles 42 includes a saddle body 42A that has a long angular-headed pipe-like shape and extends in the longitudinal direction of the strings 4, a pipe section 42B that extends in the rear-face direction (downwards in FIG. 3) from the rear face of the head-side end of the saddle body 42A, and a pressed section 42C that extends toward the tail side from the tail-side end of the saddle body 42A. The saddle body 42A has in its center a lever attachment hole 60 which is opened through the front and rear faces. A string supporting section 64 for supporting the string 4 is formed in the section nearer to the head side than the lever attachment hole 60. The string supporting section 64 is circular in cross-section (i.e., has cylindrical shape), and is provided between the left and right side walls 46A and 46B of the saddle-attaching member 32. The string supporting section 64 is supported by the rotational axis 50 so as to rotate or shift around the rotational axis 50. The lever attachment hole 60 also functions as a string extraction hole that passes the string 4 to the front-face side from the bridge saddle 42.

The pipe section 42B extends in the rear-face direction from the rear face of the saddle-attaching member 32 so that its central hole 61 connects with the lever attachment hole 60. Thus, the central hole 61 of the pipe section 42B continues to the elongated hole 45 of the saddle-attaching member 32 and the elongated hole 35 of the bridge base 31, and extends downwards in FIG. 3 from the base body 31A. The string 4 is inserted into the central hole 61 from the rear-face side, and is stopped by a ball end 19 attached to the end of the string 4 at the opening in the rear or bottom end of the pipe section 42B.

The pressed section 42C of the bridge saddle 42 extends in the tail-side direction to be located below the screw-attaching section 40 of the bridge base 31 with its tail-side end facing the connecting plate 40C. The pressed section 42C is pressed against the tip end of the string-adjusting screw 23 by a plate spring 62. The head-side end of the plate spring 62 is secured by screwing to the connector 54 of the bridge base 31, and its tail-side end is pressed against the rear face of the pressed section 42C, thereby allowing the bridge saddle 42 to apply rotational force around the axis 50 in the clockwise direction as viewed in FIG. 3.

A cam lever 66 is located in the lever attachment hole 60 in the bridge saddle 42 for tightly securing the string 4 to the string supporting section 64. A rotational axis 67 is formed on the head-side end of the cam lever 66 and supports the same so that it can rotate around the axis 67 in the front-face and rear-face directions (upwards and downwards in FIG. 3). In the state shown in FIG. 3, a cam section 66A formed at the head side end of the cam lever 66 pushes against the string 4 to secure the string 4 to the string supporting section 64. The cam section 66A has a vertical face that is approximately at a right angle to the longitudinal direction of the cam lever 66, and an R face having an appropriate radius of curvature to continue the front end of the vertical face to the front end of the front face of the cam lever 66. A tail-side end 66B of the cam lever 66 forms a control section that enables the lever to be manipulated easily by hand. The rear end 66B of the cam lever 66 protrudes from the lever attachment hole 60 and extends to the tail side of the saddle body 42A.

Figure 4:
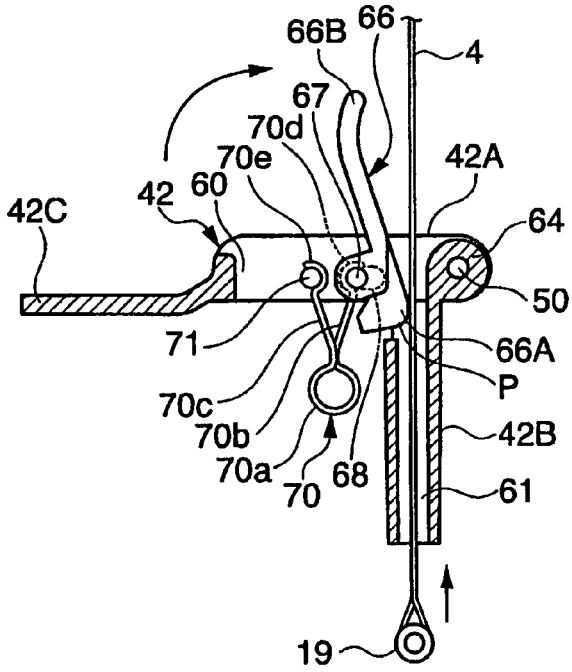
FIGS. 4, 5 and 6 is cross-sectional views showing the procedure of securing a string to the tremolo apparatus shown in FIGS. 1 to 3.

The rotational axis 67 is formed on the cam lever 66, and its axis ends are supported in elongated holes 68 that are formed in the left and right side walls 46A and 46B of the saddle body 42A of the bridge saddles 42 and extend in the head-side and the tail-side direction (see FIG. 4). The cam lever 66 can, therefore, shift in the head-side and the tail directions within a range permitted by the elongated holes 68 relative to the bridge saddles 42. The head of the bolt 15 that secures the saddle-attaching members 32 to the bridge base 31 is positioned inside or below the lever attachment hole 60.

A spring 70 is attached to the bridge saddle 42 as means for pressing the cam lever 66 in the head-side direction. By forming a wire for spring into a shape that is a reverse Ω shape when viewed in side, the spring 70 is given a C-shaped elastic deformation section 70*a*, two linear sections 70*b* and 70*c* that extend upwards from both sides of the elastic deformation section 70*a*, and C-shaped clip sections 70*d* and 70*e* that curve so as to face in the reverse directions to each other on the top end of the linear sections 70*b* and 70*c* (see FIG. 4). With deforming the elastic deformation section 70*a* in the radius-compressing direction, the spring 70 is attached to the bridge saddle 42 in a manner that its head-side clip section 70*d* is pressed from the tail side against the rotational axis 67 and its tail-side clip section 70*e* is pressed from the head side against a supporting pin 71, thereby pressing the cam lever 66 in the head-side direction via the rotational axis 67. The supporting pin 71 is positioned in the tail direction relative to the rotational axis 67 and protrudes from the inner wall of the saddle body 42A of the bridge saddle 42.

As shown in FIG. 3, when the cam section 66A of the cam lever 66 tightly secures the string 4 to the string supporting section 64 of the bridge saddles 42 by the spring force of the spring 70, the pressing point P where the cam section 66A presses against the string 4 is higher than the center height of the rotational axis 67. Making the pressing point P against the string 4 higher than the center of the rotational axis 67 in this way causes a counterclockwise rotational force having the pressing point P as its center of rotation to act on the cam lever 66. This enables the cam lever 66 to be held in a stable state, and reliably tightens the string 4. In this state, the control section 66B of the cam lever 66 directly contacts the front face of a rear wall 75 of the bridge saddle 42. At the time of tightening the string 4, the rear wall 75 of the bridge saddle 42 functions as a stopper for restricting the counterclockwise rotation of the cam lever 66 and holding it in an approximately horizontal state.

In the tremolo apparatus 30 arranged as above, one end of each string 4 is tightly secured by the cam lever 66 to the string supporting section 64 of the respective bridge saddle 42 while the other end is wound around an unillustrated peg (turning screw) on the head provided at the end of the neck of the electric guitar, thereby secured the strings 4.

When the string 4 is attached, the cam lever 66 is pulled up to rotate in the clockwise direction until it is in an approximately vertical position, as shown in FIG. 4. When the cam lever 66 is pulled up, the cam section 66A is in a lower position than the position of the rotational axis 67 and is pushed against the top of the inner wall face of the pipe section 42B by the spring 70, causing the position of the control section 66B higher than that of the rotational axis 67. In this state, since the cam lever 66 is being pressed in the head-side direction by the spring 70, it does not rotate back to the horizontal state (FIG. 3) unless manipulated.

With the cam lever 66 being in the approximately vertical state, the free end of the string 4 (the opposite end to that where the ball end 19 is attached) is inserted from the below or rear opening of the pipe section 42B into and through the central hole 61 and extracted from the lever attachment hole 60 of the bridge saddle 42 at its head-side portion. The free end of the string 4 extracted from the opening 60 is pulled us further until the ball end 19 of the string 4 is contacted against the bottom or rear opening of the pipe section 42B. This state is depicted in FIG. 4.

Figure 5:
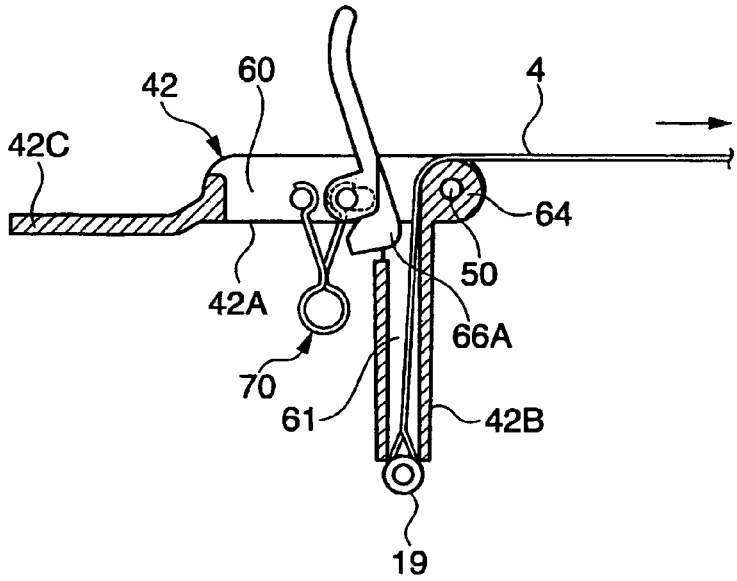

As shown in FIG. 5, the string 4 that protrudes through the lever attachment hole 60 is then bent at and along with the string supporting section 64 toward the head side.

Figure 6:
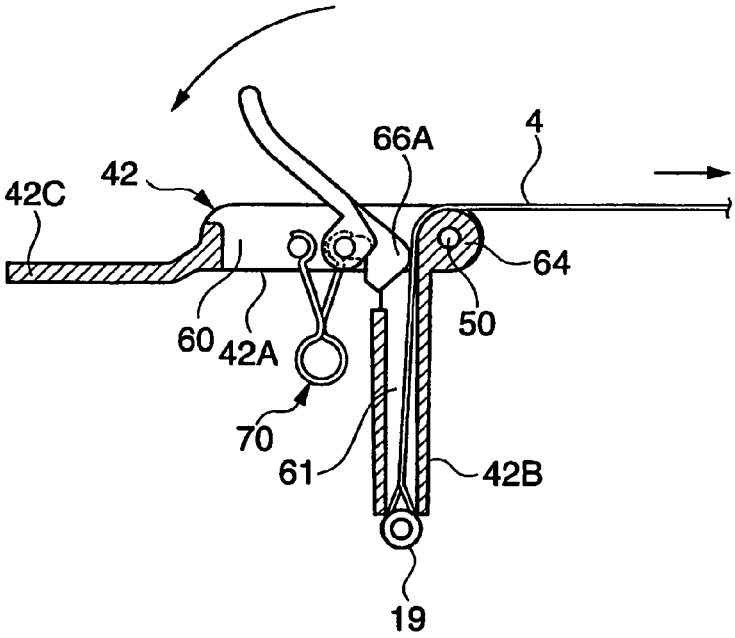
Figure 7:
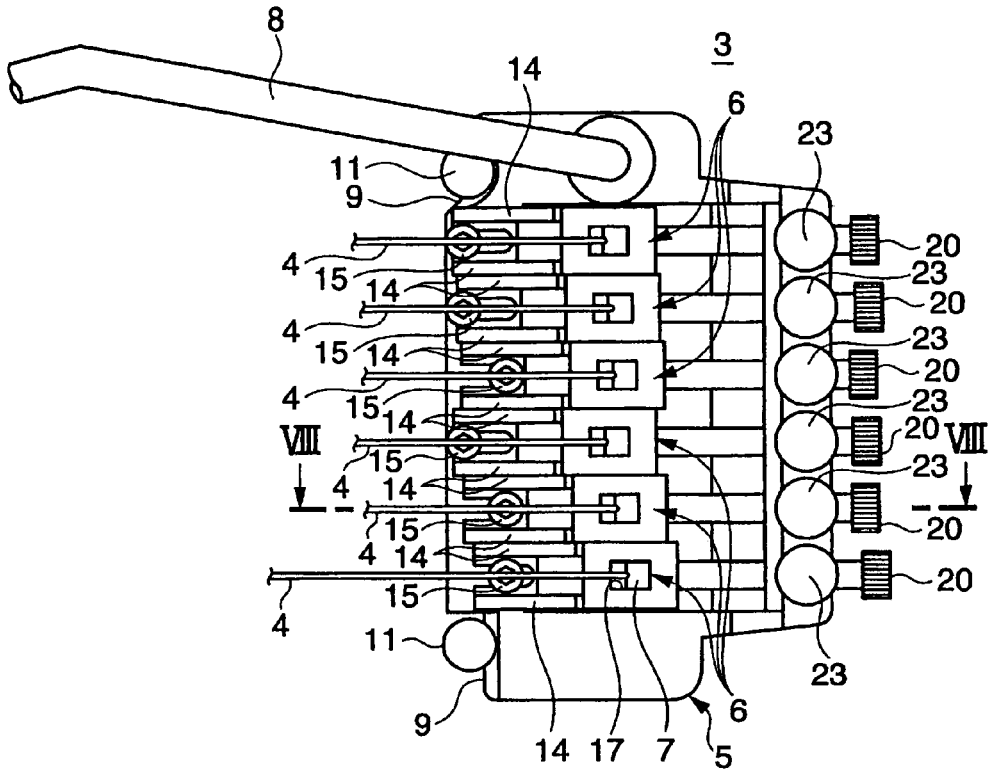
FIG. 7 is a plan view showing a conventional tremolo apparatus.

When the cam lever 66 is manually rotated or pulled down in the counterclockwise direction as shown in FIG. 6, the cam section 66A is gradually moved up and rubs with the string 4 upward. When the cam lever 66 is rotated and pulled back to the approximately horizontal state as shown in FIG. 3, the pressing point P of the cam section 66A moves higher than the center of the rotational axis 67. In this state, the cam lever 66 tightens the string 4 against the string supporting section 64 by the spring force of the spring 70 so that the end of the string 4 is secured to the bridge saddle 42. The free end of the string 4 is then wound around a peg on the head and secured to a predetermined tension.

The tension of the string 4 secured between the tremolo apparatus 30 and the peg is minutely adjusted by manually rotating the adjusting screw 23. When the adjusting screw 23 is rotated in the tightening direction, the adjusting screw 23 presses the pressed section 42C of the bridge saddle 42 downward in FIG. 3. Consequently, the bridge saddle 42 pivotally moves in the counterclockwise direction around the rotational axis 50 in FIG. 3, causing to pull the string 4 in the tail-side direction. This operation increases the tension of the string 4 and tunes it to a higher pitch. Conversely, when the adjusting screw 23 is rotated in the loosening direction, it pivotally moves the bridge saddle 42 in the clockwise direction by the spring force of the plate spring 62, causing to reduce the tension of the string 4. The string 4 is thus tuned to a lower pitch.

To adjust the actual string length of the string 4, the cam lever 66 is rotated or pulled up in the clockwise direction beforehand to be in the approximately vertical state to release the pressure against the string 4. The bolt 15 in the lever attachment hole 60 is loosened by using an L-shaped wrench and the like to allow the saddle-attaching member 32 to shift in the head-side and the tail-side directions with respect to the bridge base 31. The string-length adjusting screw 24 is then rotated to move the saddle-attaching member 32 in the head-side or the tail-side direction. This operation enables the bridge saddle 42 and the saddle-attaching member 32 to move in the longitudinal direction of the string 4 together, causing to adjust the actual string length of the string 4. After adjustment, the saddle-attaching member 32 is secured to the bridge base 31 by retightening the bolt 15, and the cam lever 66 is returned to its original horizontal state to secure the string 4 to the bridge saddle 42.

Since the tremolo apparatus 30 according to this embodiment uses the cam lever 66 for tightening and securing the ends of the strings 4 to the bridge saddles 42, no additional tool is required for tightening or releasing the strings 4 to and from the string securing apparatus. The cam lever 66 can be manipulated by hand and, therefore, enables the strings 4 to be attached and replaced easily and speedily.

Since the bolts 15 that secure the saddle-attaching members 32 to the bridge base 31 are located inside the lever attachment hole 60 in the bridge saddles 42, they are almost imperceptible from the outside and do not spoil the external appearance of the tremolo apparatus 30.

When the string 4 is secured to the string supporting section 64 of the bridge saddle 42 by the cam lever 66 as in the state of FIG. 3, the pressing point P where the cam section 66A presses the string 4 is higher than the rotational axis 67 that supports the cam lever 66 to be pivotally movable. Since a component of the spring force in the head-side direction exerts on the cam lever 66 to act in a diagonally upward direction, the cam lever 66 can be maintained in the stable state.

When the pressure on the string 4 is released as in the state of FIG. 4 where the cam section 66A moves lower than the rotational axis 67, a clockwise rotational force acts on the cam lever 66, whereby pressing the cam section 66A against the string 4. The cam lever 66 thus can be stably maintained in this state.

While the above embodiment describes a case where the cam lever 66 is used as a member that presses the strings, this invention is not limited to the configuration of the pressing member, and the pressing member need only be one that can touch, press, and move away from, the string by pivotal movement.

As described above, according to the present invention, the cam lever or the like can be manipulated by hand without requiring a special tool and, therefore, enables the strings to be reliably secured to the bridge saddles.

While the preferred embodiment of the invention has been described and illustrated above, it should be understood that this is exemplary of the invention and is not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. A string securing apparatus for string instrument comprising:

a bridge base provided on a body of said string instrument;

a plurality of saddle-attaching members fixed to said bridge base;

a plurality of bridge saddles attached to said saddle-attaching members, respectively, each of said bridge saddles holding one end of a string;

a string supporting section formed on each of said bridge saddles to support the vicinity of said one end of said string;

a cam lever arranged on a portion facing said string supporting section and taking a pressing position or a releasing position relative to said string supporting section, said cam lever securing said vicinity of said one end of said string to said string supporting section when said cam lever takes said pressing position, wherein a rotation axis is formed on said cam lever, the rotation axis supporting said cam lever, said cam lever being rotatable around the rotation axis, the rotation axis being supported by an elongated hole formed on said bridge saddle so that the rotation axis can shift its position relative to said bridge saddle within a range permitted by the elongated hole; and an elastic member pressing said cam lever toward said string supporting section in said pressing position.

2. A string securing apparatus for string instrument comprising:

a bridge base provided on a body of said string instrument;

a plurality of saddle-attaching members fixed to said bridge base;

a plurality of bridge saddles attached to said saddle-attaching members, respectively, each of said bridge saddles holding one end of a string;

a string supporting section formed on each of said bridge saddles to support the vicinity of said one end of said string; and a cam lever arranged on a portion facing said string supporting section and taking a pressing position or a releasing position relative to said string supporting section, said cam lever securing said vicinity of said one end of said string to said string supporting section when said cam lever takes said pressing position, wherein said cam lever is fixed to said bridge saddle to be capable of pivotal movement and slide movement relative to said string supporting section, and further comprising a elastic-member which presses said-cam lever toward said string supporting section.

3. A string securing apparatus for string instrument comprising:

a bridge base provided on a body of said string instrument;

a plurality of saddle-attaching members fixed to said bridge base;

a plurality of bridge saddles attached to said saddle-attaching members, respectively, each of said bridge saddles holding one end of a string;

a string supporting section formed on each of said bridge saddles to support the vicinity of said one end of said string; and a cam lever arranged on a portion facing said string supporting section and taking a pressing position or a releasing position relative to said string supporting section, said cam lever securing said vicinity of said one end of said string to said string supporting section when said cam lever takes said pressing position, wherein said bridge saddle is formed with a lever attachment hole for locating said cam lever, and a fixing member that secures said saddle-attaching member to said bridge base is arranged inside said lever attachment hole.

4. A string securing apparatus for string instrument comprising:

a bridge base provided on a body of said string instrument;

a plurality of saddle-attaching members fixed to said bridge base;

a plurality of bridge saddles attached to said saddle-attaching members, respectively, each of said bridge saddles holding one end of a string;

a string supporting section formed on each of said bridge saddles to support the vicinity of said one end of said string; and a pressing member arranged on a location facing said string supporting section and taking a pressing position or a releasing position relative to said string supporting section by a pivotal movement around a rotational axis, said pressing member securing said vicinity of said one end of said string to said string supporting section when said pressing member takes said pressing position, wherein a rotation axis is formed on said pressing member, the rotation axis supporting said pressing member, said pressing member being rotatable around the rotation axis, the rotation axis being supported by an elongated hole formed on said bridge saddle so that the rotation axis can shift its position relative to said bridge saddle within a range permitted by the elongated hole; and an elastic member pressing said pressing member toward said string supporting section in said pressing position.

* * * * *